US012318656B2

(12) United States Patent
Conklin

(10) Patent No.: US 12,318,656 B2
(45) Date of Patent: Jun. 3, 2025

(54) KINETIC DISCIPLINE AND BODY POSITIONING APPARATUS

(71) Applicant: Kathleen Conklin, Madison, WI (US)

(72) Inventor: Kathleen Conklin, Madison, WI (US)

( * ) Notice: Subject to any disclaimer, the term of this patent is extended or adjusted under 35 U.S.C. 154(b) by 0 days.

(21) Appl. No.: 16/732,968

(22) Filed: Jan. 2, 2020

(65) Prior Publication Data

US 2020/0215378 A1 Jul. 9, 2020

Related U.S. Application Data

(60) Provisional application No. 62/787,971, filed on Jan. 3, 2019.

(51) Int. Cl.
*A63B 21/00* (2006.01)

(52) U.S. Cl.
CPC ..... *A63B 21/4037* (2015.10); *A63B 2210/50* (2013.01)

(58) Field of Classification Search
CPC ..... A63B 21/4037; A63B 2210/50; A63B 2071/0655; A63B 22/0285; A63B 2208/0295; A63B 2208/0242
See application file for complete search history.

(56) References Cited

U.S. PATENT DOCUMENTS 1,948,826 A * 2/1934 Peterson ..... A47L 23/24 D6/583
6,387,103 B2 5/2002 Shadduck
6,420,015 B1 * 7/2002 Nord ..... A47G 27/0231 264/293
6,663,537 B2 12/2003 McCoy
6,935,382 B2 8/2005 Buckley
7,069,607 B2 7/2006 Nichols
7,108,635 B2 * 9/2006 Howlett-Campanella ..... A63B 21/4037 D21/797
D544,281 S 6/2007 Appleby
D554,208 S 10/2007 Palaszek
7,355,134 B1 4/2008 Anderson
D572,068 S 7/2008 Lin
7,465,263 B1 12/2008 Conrad et al.
D584,093 S 1/2009 Drumm
7,485,071 B2 * 2/2009 Edwards ..... B32B 25/20 482/907
D599,149 S 9/2009 White
D615,792 S * 5/2010 Leigh ..... D6/582
7,819,777 B1 10/2010 Service
(Continued)

*Primary Examiner* — Garrett K Atkinson

(57) ABSTRACT

A multi-dimensional body positioning apparatus that can be used in the practice of pilates, yoga, tai chi, and other intelligent movement disciplines, including exercise, rehabilitation, training, physical and mental conditioning, habituation, injury prevention and recovery; in medical protocols for minimizing cascade of disabilities and maximizing muscular and neurological recovery from paralysis, congenital disorders, and auto immune illnesses; and overall healing. The body positioning apparatus includes raised portions that are plateaus that relate to the topology of the human body, which provide visual and tactile references, so the user can properly align the body during exercise or use of the apparatus. By providing these plateaus, the exercise routine can be optimized. For instance, a user can us the apparatus supervised while monitoring proper technique.

30 Claims, 6 Drawing Sheets

(56) References Cited

U.S. PATENT DOCUMENTS

D631,276 S 1/2011 White
D632,119 S 2/2011 Service
7,888,612 B1 2/2011 Anderson
7,955,224 B2 * 6/2011 Curley ..... A63B 21/4037 482/148
D646,517 S 10/2011 Noonan
8,037,555 B2 10/2011 Fowkes
D649,868 S 12/2011 Johnson
8,096,923 B2 1/2012 White
D653,894 S 2/2012 Kieffer
D657,602 S 4/2012 Service
D660,068 S 5/2012 Wang
8,192,330 B2 * 6/2012 Curley ..... A63B 26/00 D24/212
8,220,087 B2 * 7/2012 Villa ..... A63B 21/4037 482/142
8,257,817 B2 9/2012 Jacob
8,317,660 B2 11/2012 Goranson
D674,225 S 1/2013 Boyer
D685,593 S 7/2013 Boyer
8,499,383 B1 * 8/2013 Ungaro ..... A63B 23/03516 5/420
D699,978 S 2/2014 Hasta
D699,979 S * 2/2014 Tamayo ..... D6/582
D699,980 S * 2/2014 Tamayo ..... D6/589
8,701,654 B2 4/2014 Newburger et al.
D707,057 S * 6/2014 Hasta ..... D6/582
8,793,821 B2 8/2014 Fowkes et al.
8,794,975 B2 8/2014 Davey
D716,892 S * 11/2014 Schlosser ..... D21/792
D721,410 S 1/2015 Curley
8,961,372 B2 * 2/2015 Hasta ..... A47G 9/062 5/420
8,966,681 B2 * 3/2015 Burch ..... A63B 21/4037 5/907
D739,161 S * 9/2015 Seymour ..... D6/582
9,211,437 B2 * 12/2015 Soba ..... A63B 21/15
9,241,589 B2 * 1/2016 Saltzman ..... A63B 6/00
D755,304 S * 5/2016 Ackerman ..... D21/698
D781,972 S 3/2017 Bertoncello et al.
D782,585 S 3/2017 Bertoncello et al.
D791,501 S * 7/2017 Nguyen ..... D6/588
D802,065 S * 11/2017 Bertoncello ..... D21/686
D807,077 S * 1/2018 Springer ..... D6/582
D846,665 S 4/2019 DeRaimo et al.
D847,279 S 4/2019 Jordan
10,252,104 B2 4/2019 Polenz
10,315,065 B1 * 6/2019 Soba ..... A63B 21/151
D862,926 S 10/2019 Ren
10,493,350 B2 * 12/2019 DeMarch ..... G09B 19/003
10,500,438 B1 12/2019 Lemire
D878,497 S 3/2020 Miles
D878,498 S * 3/2020 Mangum ..... D6/582
D887,506 S 6/2020 Chen
D890,270 S * 7/2020 Patel ..... D21/686
10,786,702 B2 * 9/2020 DeRaimo ..... A63B 21/4037
D898,138 S 10/2020 Jordan
10,933,277 B2 * 3/2021 Calvaruso ..... A63B 21/4037
11,083,923 B2 8/2021 Potapov
2001/0034288 A1 * 10/2001 Howlett-Campanella ..... A63B 21/4037 482/23
2003/0017915 A1 * 1/2003 Prinzmetal ..... A63B 6/00 482/23
2004/0214692 A1 * 10/2004 Koenig ..... A63B 21/4037 482/909
2006/0040811 A1 2/2006 Foster
2007/0066467 A1 * 3/2007 Edwards ..... B32B 5/18 482/148
2007/0275827 A1 11/2007 Glaser
2008/0214361 A1 * 9/2008 Oster ..... A63B 21/4037 482/23
2009/0062076 A1 * 3/2009 Curley ..... A63B 26/00 482/23
2009/0181836 A1 * 7/2009 Schneider ..... A63B 6/00 482/141
2009/0297736 A1 * 12/2009 Keighley ..... B32B 25/042 428/12
2011/0118097 A1 * 5/2011 Curley ..... A63B 26/00 482/142
2012/0164202 A1 * 6/2012 Harris ..... D06M 15/21 422/243
2013/0005519 A1 * 1/2013 Khan ..... G09F 23/0066 473/565
2013/0180048 A1 7/2013 Saltzman
2013/0324382 A1 * 12/2013 Wilson ..... A61H 7/007 482/142
2014/0007345 A1 * 1/2014 Hasta ..... A47G 9/062 5/417
2014/0237718 A1 * 8/2014 Burch ..... A63B 21/4037 5/417
2014/0335319 A1 * 11/2014 Tsai ..... A63B 21/4037 428/172
2015/0328495 A1 * 11/2015 Soba ..... A63B 21/4035 5/417
2016/0045779 A1 * 2/2016 Hasta ..... A63B 21/4037 5/417
2016/0287928 A1 * 10/2016 Darnell ..... A63B 21/4037
2017/0072253 A1 * 3/2017 Tsai ..... B32B 5/024
2017/0304672 A1 * 10/2017 Tsai ..... A63B 21/4037
2018/0071568 A1 3/2018 Chesney et al.
2018/0104529 A1 * 4/2018 Aldridge ..... A61B 5/1121
2018/0318625 A1 * 11/2018 Utman ..... A63B 6/00
2021/0008406 A1 * 1/2021 Marrello ..... A63B 21/4037
2022/0241644 A1 * 8/2022 Kang ..... A63B 24/0062

* cited by examiner

KINETIC DISCIPLINE AND BODY POSITIONING APPARATUS

CROSS REFERENCE TO RELATED APPLICATION

This application claims priority to U.S. Provisional Application No. 62/787,971, filed on Jan. 3, 2019 and entitled Kinetic Discipline and Exercise Positioning Mat, the entire contents of which are hereby expressly incorporated by reference into this application.

FIELD

The present invention relates to a body positioning apparatus and more specifically to a multi-dimensional body positioning apparatus which relates to the topology of the human body and triggers proprioception, kinesthetic awareness, and other interoceptors, by the proper positioning and stimulation of sensory structures in the physical body, while rejuvenating existing, and facilitating new, neural networks.

The multi-sensorial body positioning apparatus can be used in learning, practicing, and teaching intelligent movement disciplines, exercise programs, rehabilitative protocols, physical and mental conditioning and training, habituation, injury prevention and recovery, medical protocols for minimizing cascade of disabilities and maximizing muscular and neurological recovery from paralysis, congenital disorders, and auto immune illnesses, and overall healing.

Introduction

The human body has a vast capacity for movement, learning and healing, made more efficient by inputs to the multi-sensory systems. There is an autonomic nervous system which functions without conscious and intentional focus and direction by the human mind That autonomic nervous system is not itself passive, but passive inputs affect sensory perception, proprioception, and thus the function of the autonomic nervous system and, thereby, all systems in a human. For example, 'sitting' all day has deleterious effects on the heart, circulatory system, muscle tone, lower, upper and neck spine structural integrity, pain, cognitive sharpness and emotional confidence, to name a few outcomes. Another part of the human nervous system is not at all passive but intentional, as in cognitive, conscious awareness, used in planning, and other execution of physical and mental goals. A body positioning apparatus can stimulate the automatic and the intentional capacities of a person.

Many different exercise regimens and intelligent movement disciplines are performed on various mats to provide cushioning for the body. For instance, pilates, and yoga exercises, are routinely performed on mats. Pilates is a physical and mental conditioning regimen, typically performed on a mat, which aims to improve mobility and stability by strengthening of the "Powerhouse", defined as the muscles of the abdomen, pelvis and lower back. Pilates is a technique grounded firmly in the mechanics of the skeletal system, the geometrically increasing power of coordinated musculature, and the rejuvenation of the circulatory system through breathing-systems inherent in each human body. Pilates is a mind-body technique, where emphasis on proper breathing, body alignment, and smooth, controlled, flowing movements allow a practitioner gain strength, elegance, power and freedom of movement, and to become acutely aware, cognitively, consciously, of one's own body.

Conventional mats used in the practice of pilates typically have a flat plane surface on both sides and provide cushioning for the body during exercise. These mats primarily help to protect bones, spines, and skulls against injury from contact with a hard surface. In many instances, conventional mats provide a tacky surface to prevent slipping or other injury while moving on the mat. Additionally, mats can be used to provide a space boundary when pilates or other exercises are practiced in a group.

Pilates requires precision and control of the body. Specifically, pilates requires alignment of body parts, typically all body parts, including the spine, head, torso, pelvis, arms, legs, hands and feet. While performing pilates, a practitioner must be aware, and becomes more aware of body alignment and coordinated muscle tension. The practitioner can recognize and create the internal prestress that stabilizes the entire structure- or tensegrity. However, while using a conventional mat, a practitioner cannot visually determine body alignment or muscle tension during a particular exercise or element of movement without changing both alignment and muscle tension in order to be able to see. To ensure proper alignment or muscle tension, an outside observer, like a teacher, needs to assist the practitioner. In solo practice, there is no outside observer to change or refine the alignment, therefore, some other stimuli or trigger is necessary for the practitioner to independently and autonomously assure alignment and uniform muscle usage and development.

The planar nature of conventional mats does not provide any kinesthetic reference other than the mat edge itself. Aside from the tack and friction provided by the mat's surface, there is no proprioceptive stimulus or incentive for the practitioner when making adjustments on the mat. A practitioner using a conventional mat can, only guess whether the body is properly aligned, such as where feet are properly spaced; whether shoulders are aligned, hips are askew, one arm is closer to the body than the other, the head is turned; or if there is cervical spine side-bending, or the thoracic and lumbar spine segments are aligned. Working on a conventional mat while unsure of body placement can, over time, produce asymmetrical movement patterns and reinforce inefficient habits. This, in turn, can result in neurological inefficiencies and deficiencies. One of the goals of pilates, and other intelligent movement techniques, is, for example, 'self-determinance'. Conventional mats do not facilitate improved and improving physiological and neurological capacities for the practitioner in an autonomous setting, i.e., using a conventional mat solo or on their own. A practitioner's outcome might well run counter to the stated goals. In other words, a flat mat may not only be unhelpful, it may be hurtful and counterproductive.

In their evolving practice of integrated mind-body psychotherapies, mental health workers note that human bodies register and store traumatic events in a range of physical systems, which, for example, manifest in physical posture, carriage, and gait. Integrative psychotherapies often support the release of trauma, anxiety, and depression through training patients in adjusting posture, carriage, and gait, as well as in the release of traumatic tension through mat work. The body positioning apparatus can accelerate mind-body integrative psychotherapies by allowing patients to acquire and remember proper alignment, and feel and sustain its relief.

In the course of living with a range of injuries and illnesses, people often are confined to beds, with limited opportunities for exercise or using their own bodies to support their necks, limbs, and spines. During periods of confinement as a result of injury, illness, or progressive disease, muscles atrophy and alignment suffers, making a return to previous functioning a deep challenge.

A wide range of experts and commentators express concern about postural changes among technology workers, office workers, and users of personal device technologies, whose postural alignment suffers as a result of work and daily life centered around the use of computers and cell phones.

SUMMARY

The present invention relates to a body positioning apparatus which facilitates the user, without outside observer, through haptic cues and visual perceptions to achieve correct and optimum body position and alignment by triggering proprioception and kinesthetic awareness and overall interoception. Raised plateaus in the apparatus, and their relative recesses, relate to the topology and neurology of the human being. The haptic cues of touch, pressure, temperature and traction, provided by/through the apparatus, as well as visual information, provide referents. No other mat or apparatus currently provides those haptic cues. Referential cues lead to internal feedback in the user. This, in chain, gives rise to conscious 'thought' about the input. The user is first aware of prior practiced ability or innate ability. The user then becomes aware of discrepancies in innate symmetry or ability and practiced performance. This 'gap identification' allows for consistent systematic recognition of the gap in ability or symmetry or performance. The haptic cues for symmetrical behavior provided by the body positioning apparatus allow for learning from the optimum experience or performance, to teach the 'impaired' side or element of the body.

The self-referential matrix provided through the body positioning apparatus helps the user to find a threshold of sensitization. This consciousness is motivated internally, not by an outside force. The internalized behavior by the user literally changes the neural network. Failure to develop new neural networks contributes to decline. This increased sensitization, then, is a fountain of youth. The body positioning apparatus can facilitate new neural networks and awaken the existing but unused neural networks. The body positioning apparatus facilitates healthy habituation, encouraging first the development of new neural networks, then the kinesiological entrainment, and finally the psycho-physical satisfaction which results in cognitive-driven physicality. The user will return again and again.

The body positioning apparatus allows someone to be in proper position without outside assistance. Alternatively, it also makes it easier for an assistant, like a teacher, therapist, doctor, or other outside observer, to help a person be in the optimum body position; and it can be used passively or dynamically in the realms—such as medical or educational—involving assistants. Passive use is where the dimensions of the body positioning apparatus 'work' on the user even when the user is at rest, that is, even without conscious or sensory awareness, for example, paralysis, coma, other cognitive disabilities. Dynamic use of the body positioning apparatus is by a user intending to improve outcomes or performance, and/or by an outside observer, for example, therapist, teacher, doctor, etc., to provide therapy, education or instruction.

The body positioning apparatus also enhances the teacher's talent and experience, improving the efficiency and impact of the teaching. The performance by the user of the body positioning apparatus is perceptible by the user, but another consequence is it is perceived by a teacher, if one is present. The teacher, then, learns to be more efficient in teaching. This promotes longevity in the teacher, and also generates opportunities for new teachers, despite a decreasing expectation in the apprenticing or training of, or innate talent in, teachers. The body positioning apparatus allows for safe, reliable, increasingly improved performance by the user, in the event of, or despite, the decreasing competency of teachers in the intelligent movement disciplines. Though not desirable, there is a reduction in talent and training of teachers. However, the body positioning apparatus reduces the need for a teacher to have extensive background or education, while allowing superb outcomes for the practitioner/user despite that fact. No other apparatus is the perpetual motor of the ultimate human being, one free of machines and gear under its own innate design and power in a field of force called gravity, to discover continually refined precision, alignment, efficiency and sufficiency, and continuous physical and mental learning and emotional satisfaction.

A specific example of the usefulness of the body positioning apparatus to learning, practicing, and teaching, is its application in exercise and intelligent movement disciplines.

The body positioning apparatus can be placed under people who are bedridden to provide passive alignment support and discourage the shifting and slumping that happens as people lose muscle strength during confinement. The body positioning apparatus can be placed under these patients by lesser skilled health care staff and still achieve optimum alignment for the person bedridden.

In the course of therapies to recover strength, balance, and alignment, physiatrists, physical therapists, chiropractors, osteopaths, and other practitioners can use the body positioning apparatus to help patients develop the felt sense of postural alignment, and can train people to integrate the body positioning apparatus into their personal recovery work.

The body positioning apparatus can be used in educational, office, and home environments as a corrective and preventive tool that counter-balances the emerging chronic misalignment of modern human spines as people interact with computers and cell phones. Pre-schools and kindergartens may adopt the body positioning apparatus in place of the classic nap mat; primary, middle, and high schools may integrate the body positioning apparatus in physical education, wellness, and sports applications. Workplace applications may be through personal or organizational adoption.

The body positioning apparatus can also be used in meditation and relaxation disciplines.

The body positioning apparatus can also be used in conventional gyms or workout facilities to improve outcomes for the individual practitioners; and impact liability for the instruction staff and the facilities.

The present invention is directed to an inventive body positioning apparatus configured to overcome one or more of these issues by facilitating proprioceptive awareness in a practitioner, e.g., user, using the inventive body positioning apparatus by providing at least a plurality of pairs, i.e., at least three, of spaced apart landmarks on the inventive body positioning apparatus positioned on the inventive body positioning apparatus and relative to one another in a manner that helps ensure proper body alignment during practitioner use of the body positioning apparatus. Such an inventive body positioning apparatus has at least a plurality of pairs, i.e., at least three, landmarks on the body positioning apparatus spaced apart relative to one another and located on or along the inventive body positioning apparatus in an arrangement or pattern producing a body positioning apparatus in accordance with the present invention that a practitioner can and preferably does use without the help, guidance or assistance of anyone else ("solo practitioner use"). While the inventive body positioning apparatus incorporates many of the advantages of conventional body positioning apparatus, including portability, individual use, low-maintenance, and minimal training curve, the inventive body positioning apparatus has an arrangement or pattern of landmarks that enables solo practitioner use of the inventive body positioning apparatus. Additionally, the inventive body positioning apparatus improves upon conventional body positioning apparatus by adding a number of distinct and novel features to facilitate a user in practice of cognitive movement technique, such as in the practice of pilates, or as in executing or facilitating other medical, exercise, or therapeutic regimen. These features include landmarks which provide visual cues and reference points in the form of projections and recesses on the body positioning apparatus. Such projections and recesses are arranged relative to one another on the inventive body positioning apparatus producing an apparatus of the present invention configured to enable a practitioner to achieve and maintain proper body alignment and positioning while using the inventive body positioning apparatus all by themselves without any assistance, guidance or help from anyone else (including an instructor).

The body positioning apparatus of the present invention includes a front side which faces upwardly toward the practitioner which has raised portions which are landmarks or "plateaus" that can be symmetric across both the longitudinal and latitudinal axes, which correspond to a topology or body part map corresponding to a user's body. This topography provides the user with kinesthetic cues, proprioceptive cues, and neurological mapping while using the inventive body positioning apparatus. These raised portions provide the user with reference points to ensure that he or she is using proper technique during an exercise routine, intelligent movement discipline, exercise, or recommended medical or therapeutic regimen. For example, plateaus are located about the body positioning apparatus to guide the user into correct hand and feet placements during exercise, movement or therapy. Still other plateaus can provide references for head, torso, shoulder and pelvis placements. The inventive body positioning apparatus can also include a raised center line down the longitudinal axis of the apparatus to help guide the user into proper spinal alignment. Additionally, the inventive body positioning apparatus is foldable along creases that run parallel to the latitudinal axis. These creases not only allow the apparatus to fold and become portable, but also provide more practitioner and/or user (hereinafter "user") guidance for positioning on the apparatus during use.

A preferred embodiment of an apparatus constructed in accordance with the present invention is three-dimensionally contoured with the inventive body positioning apparatus having at least a plurality of pairs, i.e., at least three, of landmarks, preferably upraised, which can be three-dimensionally shaped, and which are configured to provide body positioning apparatus locations on which one of at least a part of a user's head, torso, shoulder, pelvis, hand, foot, arm, or leg is supported and/or provide apparatus location body positioning references or guides along or over which a portion of the user's body is aligned. In one preferred embodiment, the body positioning apparatus has at least one plurality of body-part supporting landmarks engaged by part of a user's body during apparatus use, and has at least one other plurality of body-part aligning landmarks that serve as a guide for aligning or locating part of a user's body relative thereto during apparatus use. In one such preferred embodiment, at least a plurality of the body-part supporting landmarks are upraised from an outer surface of the apparatus. In another such preferred embodiment, at least a plurality of the body-part supporting landmarks and at least a plurality of the body-part aligning landmarks are upraised from the outer surface of the apparatus. In a preferred embodiment, the inventive body positioning apparatus has at least a plurality of landmarks disposed on each side of a longitudinal axis or longitudinal centerline of the apparatus, and has at least a plurality of landmarks disposed on each side of a transverse axis or transverse centerline of the apparatus.

In at least one of the aforementioned inventive body positioning apparatuses, the longitudinal axis or longitudinal centerline and transverse axis or transverse centerline divides the inventive body positioning apparatus into four quadrants, each of which has at least a plurality, preferably at least a plurality of pairs, i.e., at least three, spaced apart landmarks. In at least one such inventive body positioning apparatus, at least a plurality, preferably at least a plurality of pairs, i.e., at least three, of the landmarks in one quadrant is spaced apart and arranged in a pattern that is symmetrical to at least a plurality, preferably at least a plurality of pairs, i.e., at least three, of the landmarks in an adjacent or adjoining quadrant. In at least one such inventive body positioning apparatus, at least a plurality, preferably at least a plurality of pairs, i.e., at least three, of the landmarks on one side of one of the longitudinal axis or longitudinal centerline and the transverse axis or transverse centerline is spaced apart and arranged in a pattern that is symmetrical to at least a plurality, preferably at least a plurality of pairs, i.e., at least three, of the landmarks on an opposite side of the one of the longitudinal axis or longitudinal centerline and the transverse axis or transverse centerline, and at least a plurality of pairs, i.e., at least three, of the landmarks on one side of the other one of the longitudinal axis or longitudinal centerline and the transverse axis or transverse centerline is spaced apart and arranged in a pattern that is symmetrical to at least a plurality, preferably at least a plurality of pairs, i.e., at least three, of the landmarks on an opposite side of the other one of the longitudinal axis or longitudinal centerline and the transverse axis or transverse centerline.

By being upraised from the front surface or recessed into the front surface of the body positioning apparatus, a user of the body positioning apparatus can feel for one or more of the various landmarks upon which the user can then engage, such as by grasping, engaging, or resting thereon, or align a part of their body relative thereto, such as by aligning the body part over a corresponding one of the upraised landmarks. In addition, by the landmarks being underneath the body of the user, the user can feel the landmarks without sitting up to look for the landmarks, and thus get, or stay, in proper position without lifting his or her head up to look. Additionally, by having the landmarks underneath the body of the user, the user can engage one or more appropriate corresponding body parts while being over or on the apparatus, and can position one or more body parts relative to one or more positioning landmarks. Further still, the user can see the land marks when prone or looking down at the earth, and can achieve a desired alignment of the body in practicing pilates, yoga or other intelligent movement, habituation or rehabilitation.

These landmarks or "plateaus" allow a practitioner using the inventive body positioning apparatus to achieve, preferably by feel, the appropriate alignment without having to rely on another individual thereby facilitating and preferably enabling solo practitioner use of the inventive body positioning apparatus. At the same time, the inventive body positioning apparatus prevents a practitioner during solo use of the body positioning apparatus from having to raise their head to look for proper alignment, which is commonplace during conventional mat use and detrimental as it takes the user out of anatomically neutral alignment. The three-dimensionally contoured topography of the landmarks of the inventive body positioning apparatus can and preferably also does facilitate efficiency, accuracy, and expediency, including when a practitioner using the inventive body positioning apparatus is working with a teacher or other outside observer (such as during an initial training period as to how to use the inventive body positioning apparatus, or during therapy, or other medical protocol), since there is a commonality and continuity of reference points commonly used in pilates and with reference to the human body. This can and preferably does result in the practitioner having a richer experience in autonomous use of the inventive body positioning apparatus.

DRAWINGS DESCRIPTION

One or more preferred exemplary embodiments of the invention are illustrated in the accompanying drawings in which like reference numerals represent like parts throughout and in which.

DETAILED DESCRIPTION

Figure 1:
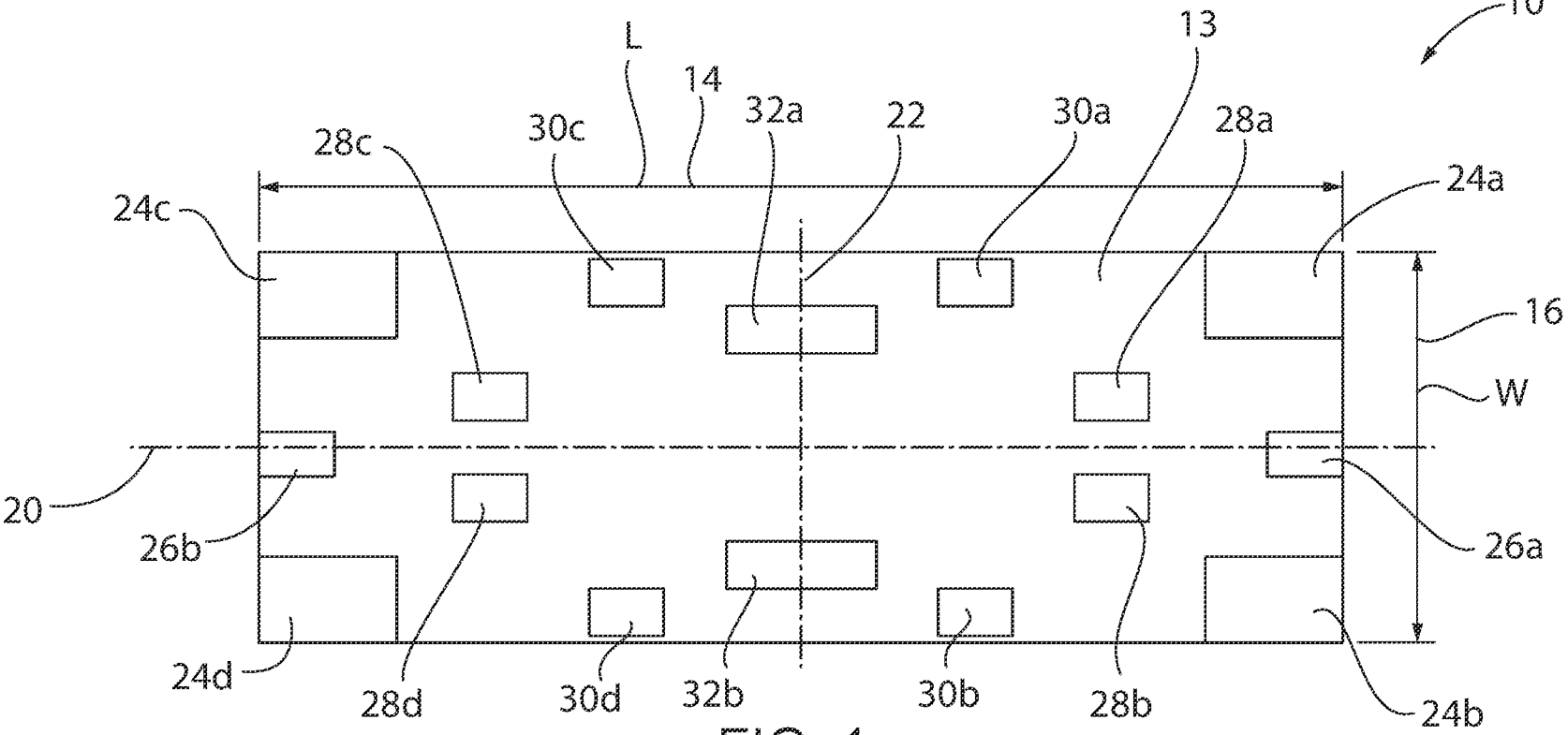
FIG. 1 is a top plan view of the inventive body positioning apparatus.

With reference to FIGS. 1-4, the present invention is directed to a body positioning apparatus 10 that can be made of non-volatile, non-outgassing, durable, pliant, resilient material. For instance, the body positioning apparatus 10 may take the form of a mat or exercising mat that is specifically designed for various exercises or activities. The body positioning apparatus 10 has a thickness of between 0.5 inch and 1.0 inches of material, and as shown a thickness of approximately 0.625 inches. Of course, the body positioning apparatus 10 could be thicker or thinner to optimize use of the body positioning apparatus 10 based on a number of factors, including the specific exercise that the body positioning apparatus 10 is being used with, the material that the body positioning apparatus 10 is made of, physical characteristics of the user including weight, the surface on which the body positioning apparatus 10 is placed, and the like. The body positioning apparatus 10 is sized and shaped to accommodate a user body 12, wherein the length L of the body positioning apparatus 14 is longer than the width W of the body positioning apparatus 16. By way of example, the body positioning apparatus 10 can be between 65 to 84 inches long and between 18 to 34 inches wide. As shown, the body positioning apparatus 10 is approximately 67.50 inches long and approximately 24 inches wide. Of course, the body positioning apparatus 10 could be longer and shorter, or wider or narrower to accommodate the specific dimensions of a given user. The body positioning apparatus 10 can be printed, cutout, rolled, stamped, or otherwise formed to have the specific dimensions discussed herein. Also, the body positioning apparatus 10 can be made of any number of different materials, including for instance foam, plastic, polyvinyl, hemp, bamboo, or recycled material.

Figure 2:
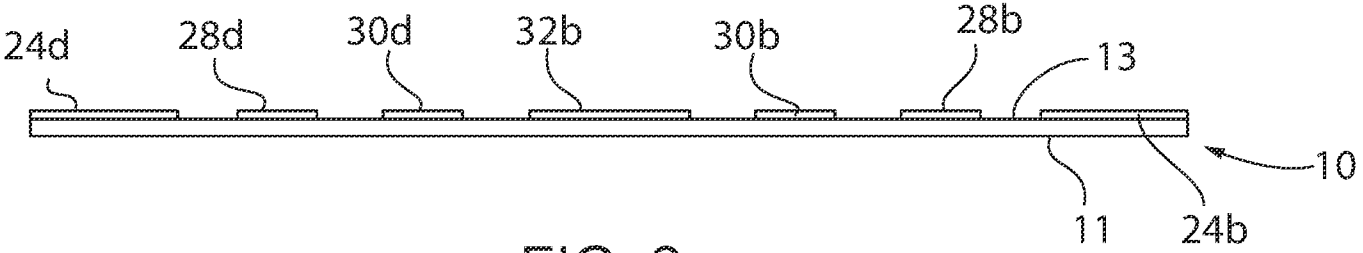
FIG. 2 is a side elevation view of the inventive body positioning apparatus of FIG. 1.

The body positioning apparatus 10 has a back planar surface 11 extending along a level plane and a front planar surface 13. Additionally, the body positioning apparatus 10 has a number of raised portions that will be further described below having elevations that extend from the front planar surface 13 by 0.20 inches to 1.0 inches. For instance, as shown, the raised portions extend approximately 0.25 inches from the front planar surface 13 of the body positioning apparatus 10, as shown in FIG. 2. These raised portions correspond to the topology of the user's body and are to be used as guides and references for positioning the user body on the body positioning apparatus during exercise or use.

The body positioning apparatus 10 can also include a raised center line 18 on the front planar surface made of the same material as the body positioning apparatus. For instance, the center line 18 can extend along the entire length of the longitudinal axis 20 or it can extend along a portion of the longitudinal axis 20. For instance, the raised center line 18 can extend between 65 to 84 inches. As shown, the raised center line extends approximately 67.50 inches along the longitudinal axis 20. The raised center line 18 is used, for example, for reference to align the head, spine, and tailbone, and to guide heel placement of the user's body 12.

The body positioning apparatus 10 can include any number of raised portions. For instance, the body positioning apparatus 10 can include ten to eighteen raised portions, although additional or fewer raised portions could be used based on a number of factors including the exercise being performed on the body positioning apparatus. With reference to FIGS. 1 and 2, the body positioning apparatus 10 includes sixteen raised portions, herein referred to as "plateaus". These plateaus are configured to be symmetrical about both the longitudinal and latitudinal axes 20, 22 and are intended to be used to guide the placement of head, torso, shoulders, hands, pelvis, legs, heels, and other parts of the user body 12 during exercise.

The specific plateaus shown in FIGS. 1 and 2 will now be described. The body positioning apparatus 10 includes four raised rectangular corner plateaus 24*a*, 24*b*, 24*c*, 24*d* (collectively 24) located at each corner of the body positioning apparatus 10. These corner plateaus 24 are to guide the user to correct heel and hand placement during full extension. The four corner plateaus 24 can range from 7 to 10 inches long and 4 to 7 inches wide. As shown, these corner plateaus are approximately 8.50 inches long and approximately 5.50 inches wide. The first corner plateau 24*a* is symmetrical relative to the second corner plateau 24*b* about the longitudinal axis 20, as are the third corner plateau 24*c* and the fourth corner plateau 24*d*. Additionally, the first corner plateau 24*a* is symmetrical relative to the third corner plateau 24*c* about the latitudinal axis 22, as are the second corner plateau 24*b* and the fourth corner plateau 24*d*.

Additionally, the body positioning apparatus 10 shown in FIGS. 1 and 2 further includes two end plateaus 26*a*, 26*b* (collectively 26) at either end of the body positioning apparatus 10, bisecting the longitudinal axis 20. These two end plateaus 26 can range from 3 to 6 inches in length and 2 to 4 inches in width. As shown, both of the end plateaus 26 are approximately 4.50 inches long and 2.75 inches wide. The first end plateau 26*a* and the second end plateau are symmetrical about the latitudinal axis 22, and centered on the longitudinal axis 20.

Further still, the body positioning apparatus 10 shown in FIGS. 1 and 2 has four inner plateaus 28*a*, 28*b*, 28*c*, 28*d* (collectively 28) spaced from both the latitudinal axis 22 and longitudinal axis 20. For instance, these plateaus 30 may be equidistantly spaced from the latitudinal axis 22 and equally spaced from the longitudinal axis 20. The inner plateaus 28 can be distanced from the latitudinal axis 22 by a distance of between 16 inches and 23 inches, and as shown, lie laterally from the latitudinal axis starting at 17.25 inches and extending through 21.75 inches. Additionally, the inner plateaus 28 can be distanced from the longitudinal 20 axis by a distance of between 0.5 inch and 6 inches, and as shown laterally from the longitudinal axis on either side starting at 1.50 inches and extending through 4.25 inches. The four inner plateaus 28 can range from 3 to 6 inches in length and 2 to 4 inches in width, and as shown are approximately 4.50 inches in length and 2.75 inches in width. Of course, these distances are exemplary, but should not be construed as limiting. Any of these dimensions could be changed without departing from the spirit of the present invention.

Also, the body positioning apparatus 10 shown in FIGS. 1 and 2 has another four outer plateaus 30*a*, 30*b*, 30*c*, 30*d* (collectively 30) spaced from both the latitudinal axis 22 and longitudinal axis 20. For instance, these plateaus 30 may be equidistantly spaced from the latitudinal axis 22 and equally spaced from the longitudinal axis 20. The outer plateaus 30 can be distanced from the latitudinal axis 22 by a distance of between 8 inches and 13 inches, and as shown, spaced from the latitudinal axis 22 at a distance less than halfway from the latitudinal axis 22 to the body positioning apparatus's left edge 60*a* or right edge 60*b*. Additionally, the outer plateaus 30 can be distanced from the longitudinal axis 20 by a distance of at 8.75 inches and extending through 11.50 inches on either side of the longitudinal axis 20. The four plateaus 30 can range from 3 to 6 inches in length and 5 to 10 inches in width. As shown, the four outer plateaus are approximately 4.50 inches long and approximately 2.75 inches wide. Again, these distances are exemplary, but should not be construed as limiting. Any of these dimensions could be changed without departing from the spirit of the present invention.

Additionally, the body positioning apparatus 10 shown in FIGS. 1 and 2 include two elongated rectangular plateaus 32*a*, 32*b* (collectively 32) positioned to be used as first and second pelvis references. The two elongated plateaus 32 lie at a location along the latitudinal axis 22 and are laterally spaced from the longitudinal axis 20 by a distance of between 5 inches and 10 inches. As shown, the two plateaus 32 bisect the latitudinal axis 22 and lie laterally from the longitudinal axis 20 starting at approximately 6.0 inches and extending through approximately 8.75 inches. The two elongated plateaus 32 range from 8 to 10 inches in length and 2 to 4 inches in width, and as shown are approximately 9.25 inches long and 2.75 inches wide.

Figure 3:
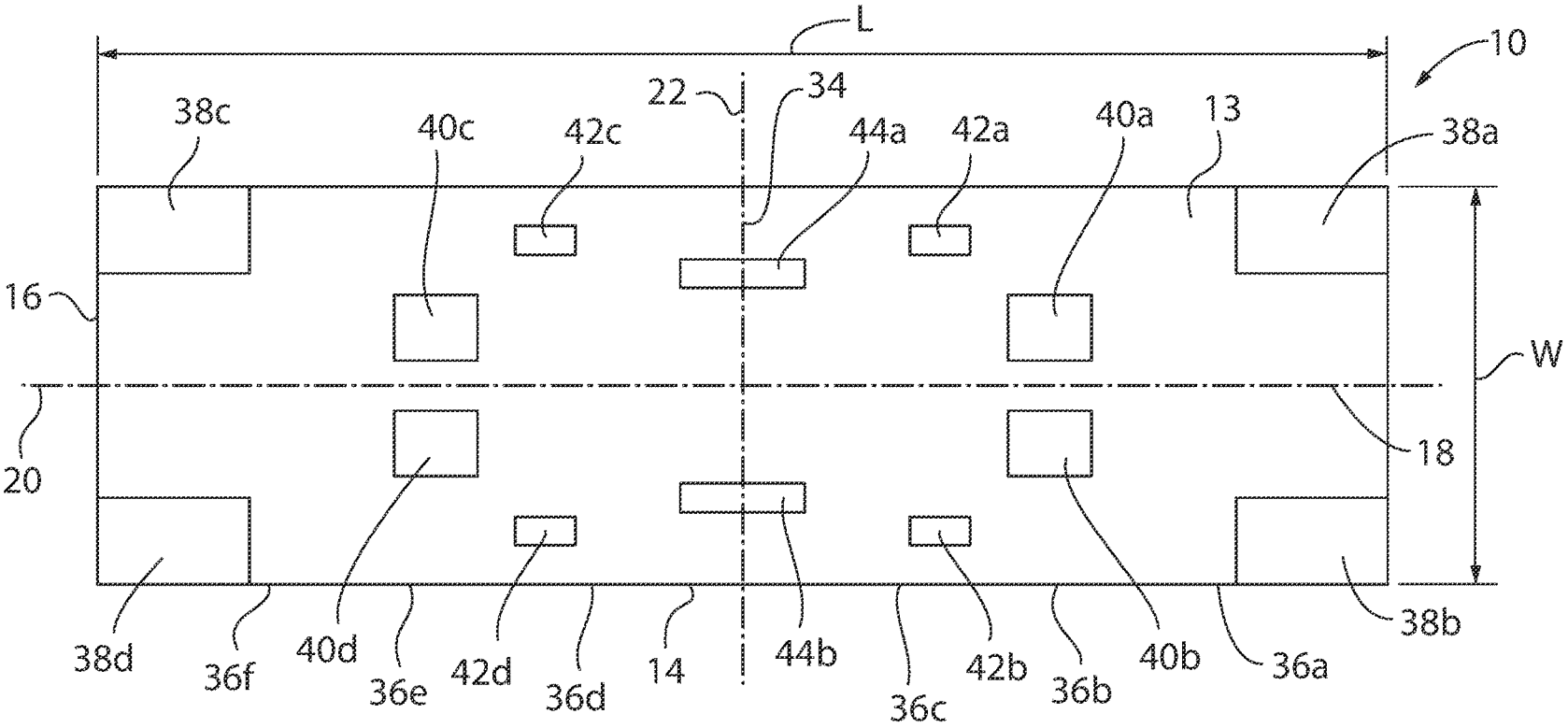
FIG. 3 is a top plan view of another embodiment of the inventive body positioning apparatus.
Figure 4:
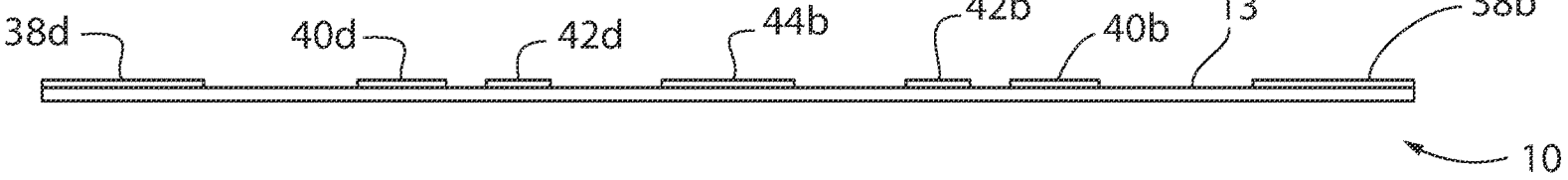
FIG. 4 is a side elevation view of the inventive body positioning apparatus of FIG. 3.

With reference to FIG. 3, a second embodiment of the body positioning apparatus 10 includes fourteen raised plateaus that are symmetric across both the longitudinal and latitudinal axes 20, 22. Generally speaking, the plateaus shown in FIG. 3 are similar to those shown in FIGS. 1 and 2 and described above, with the exception of the two end plateaus 26. The body positioning apparatus 10 includes a number of folds that allow the body positioning apparatus 10 to be folded into a compressed configuration. For instance, the body positioning apparatus 10 shown in FIG. 3 folds at a center line 34 bisecting the length L of the body positioning apparatus 10. Additionally, the body positioning apparatus 10 can also fold at 9.75 inch to 12 inch increments from the first center fold 34 along creases 36*a*, 36*b*, 36*c*, 36*d*, 36*e*, and 36*f* (collectively 36). Of course, the body positioning apparatus 10 can have additional creases or fewer creases as desired. The body positioning apparatus 10 shown in FIGS. 1 and 2 can also include a similar folding function. The creases 36 of the folding function can also serve as additional tactile references for positioning a user body on the body positioning apparatus properly during use.

The second embodiment has four raised rectangular corner plateaus 38*a*, 38*b*, 38*c*, 38*d* (collectively 38) located at each corner of the body positioning apparatus 10. These corner plateaus 38 are similar in location, size, and shape to the corner plateaus 24 described above. Another four inner plateaus 40*a*, 40*b*, 40*c*, 40*d* (collectively 40) are located laterally from the latitudinal axis 22 in both directions starting at 20 inches and extending through 26 inches and laterally from the longitudinal axis 20 in both directions starting at 2.0 inches and extending through 5.5 inches. These inner plateaus 40 are similar in location, size, and shape to the corner plateaus 28 described above. Four more outer plateaus 42*a*, 42*b*, 42*c*, 42*d* (collectively 42) are located laterally from the longitudinal axis in both directions starting at 8.50 inches through 10.50 inches and laterally from the latitudinal axis in both directions starting at the first bisecting fold from the horizontal center fold and extending 4.0 inches. These outer plateaus 42 are similar in location, size, and shape to the outer plateaus 30 described above. This embodiment shown in FIG. 3 also includes two elongated rectangular plateaus 44*a*, 44*b* (collectively 44) located along the latitudinal axis and laterally on either side of the longitudinal axis starting at 6.50 inches through 8.0 inches. The two plateaus 44 are similar in location, size, and shape to the elongated plateaus 32 described above.

Figure 5:
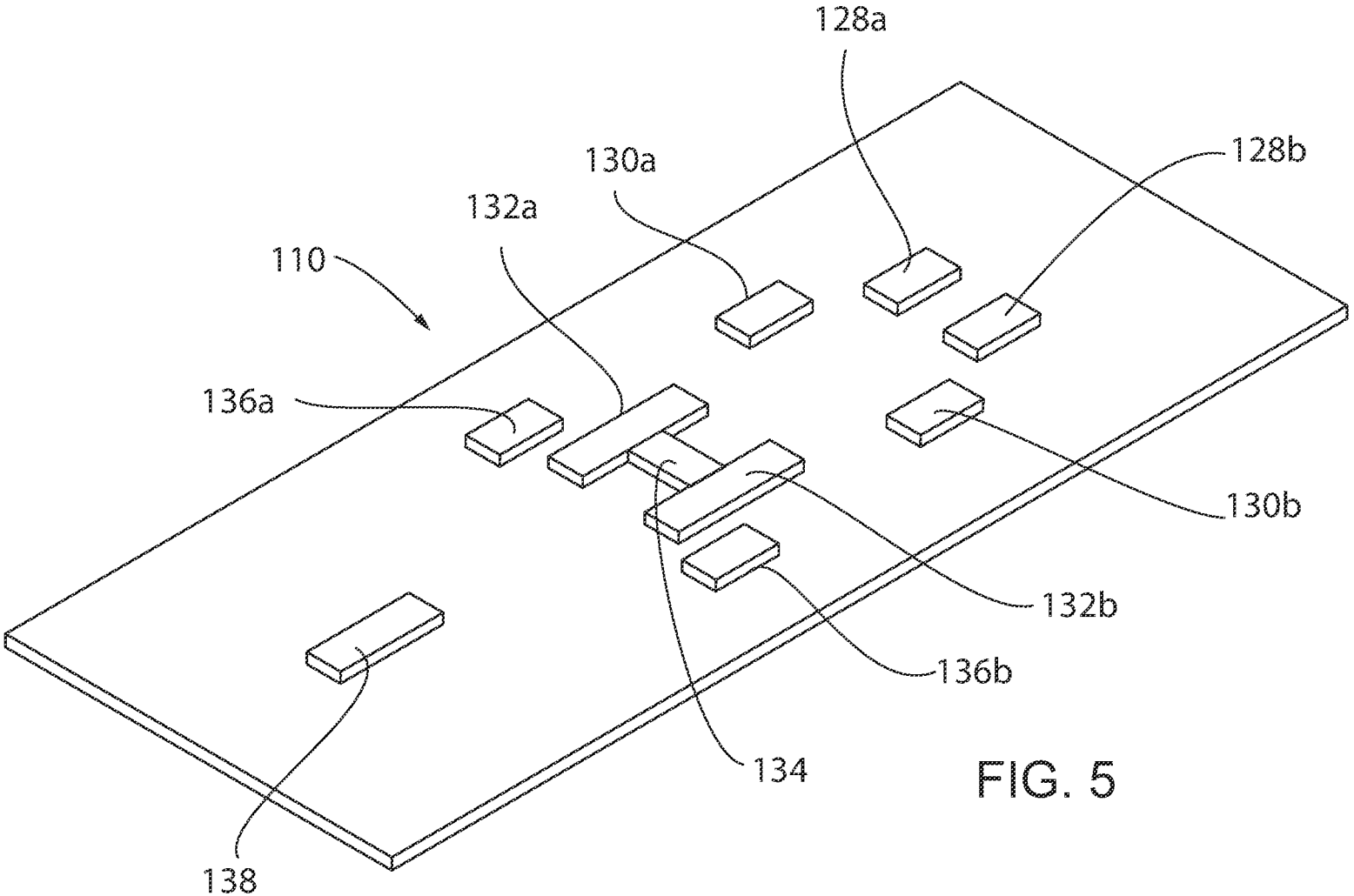
FIG. 5 is an isometric view of yet another inventive body positioning apparatus.
Figure 6:
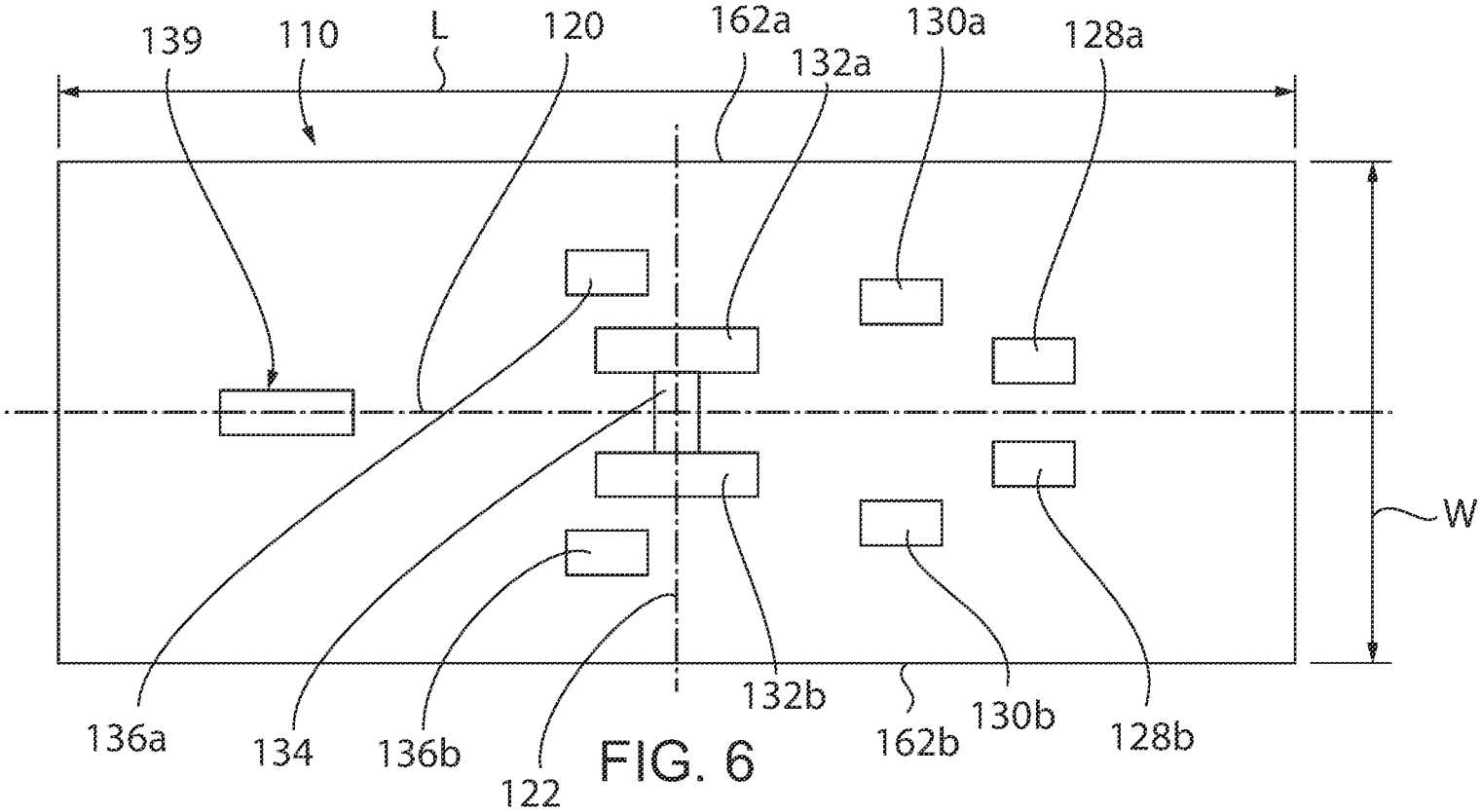
FIG. 6 is a top plan view of the inventive body positioning apparatus of FIG. 5.
Figure 7:
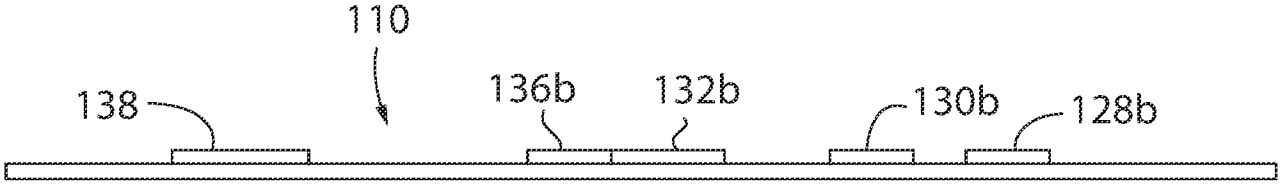
FIG. 7 is a side elevation view of the inventive body positioning apparatus of FIGS. 5 and 6.

Another embodiment of the body positioning apparatus 110 is shown in FIGS. 5-7. The body positioning apparatus 110 as shown may be between approximately 28-40 inches, and more preferably approximately 34 inches in width, and between approximately 78-90 inches, and more preferably 84 inches in length. The specific plateaus shown in FIGS. 5-7 will now be described. The body positioning apparatus 110 has two upper inner plateaus 128*a*, 128*b* (collectively 128), which serve as a pair of head plateaus that are spaced from the longitudinal axis 120. For instance, these plateaus 128 may be equidistantly spaced from the longitudinal axis 120. The inner plateaus 128 can be distanced from the longitudinal 120 axis by a distance of between 0.5 inch and 6 inches, and as shown laterally from the longitudinal axis 120 by a distance of approximately 2 inches. Stated differently, the inner plateaus 128 may be distanced from one another by approximately 4 inches. Additionally, the inner plateaus 128 may be distanced from the latitudinal axis 122 by a distance of between 15-25 inches, and more preferably approximately 21.5 inches. The two inner plateaus 128 can range from 2-8 inches in length and 1-5 inches in width, and as shown are approximately 5.5 inches in length and 3 inches in width. As such, the inner plateaus 128 extend from the latitudinal axis 122 by 21.5-27 inches. Additionally, the two inner plateaus 128 may have a height of between approximately 0.5-1.5 inches, and more preferably approximately ⅞ inch. Of course, these distances are exemplary, but should not be construed as limiting. Any of these dimensions could be changed without departing from the spirit of the present invention.

Also, the body positioning apparatus 110 has another two upper outer plateaus 130*a*. 130*b* (collectively 130), which serve as a pair of shoulder plateaus that are spaced from the longitudinal axis 120. For instance, these plateaus 130 may be equidistantly spaced from the longitudinal axis 120. The outer plateaus 130 can be distanced from the longitudinal axis 120 at a distance approximately halfway from the longitudinal axis 120 to the body positioning apparatus's top edge 162*a* or bottom edge 162*b*. As shown, the outer plateaus 130 are distanced approximately 4-8 inches from the longitudinal axis 120, and more preferably, approximately 6 inches from the longitudinal axis 120. Stated differently, the outer plateaus 130 may be spaced approximately 12 inches apart from one another. Additionally, the outer plateaus 130 are distanced approximately 6-20 inches, and more preferably approximately 12.5 inches from the latitudinal axis 122. The two plateaus 130 can range from 2-8 inches in length and 1-5 inches in width, and as shown are approximately 5.5 inches in length and 3 inches in width. As such, the plateaus 130 extend from the latitudinal axis 122 by 12.5-18 inches. Additionally, the two outer plateaus 130 may have a height of between approximately 0.5-1.5 inches, and more preferably approximately ⅞ inch. Again, these distances are exemplary, but should not be construed as limiting. Any of these dimensions could be changed without departing from the spirit of the present invention.

Additionally, the body positioning apparatus 110 includes two elongated rectangular plateaus 132*a*, 132*b* (collectively 132) positioned to be used as first and second pelvis references. Additionally, the apparatus 110 may include a third plateau 134 that extends between the two plateaus 132 along the latitudinal axis 122, which results in a substantially "H" shaped pelvis plateau area. The two elongated plateaus 132 are centered about the latitudinal axis 122 and are laterally spaced from the longitudinal axis 120 by a distance of between approximately 2 inches and 10 inches, and more preferably approximately 3 inches. The two elongated plateaus 132 range from approximately 6-18 inches in length, and more preferably approximately 11 inches in length. Additionally, these plateaus 132 are approximately 2 to 4 inches in width, and more preferably approximately 3 inches in width. The third plateau 134 is centered relative to both the longitudinal axis 120 and the latitudinal axis 122 and is preferably is between 2-8 inches in length and 1-5 inches in width, and as shown are approximately 5.5 inches in length and 3 inches in width. Each of these plateaus 132, 134 can be between 0.5-1.5 inches in height, and more preferably approximately ⅞ inch in height.

Also, the body positioning apparatus 110 has another two lower outer plateaus 136*a*. 136*b* (collectively 136), which serve as hand pair plateaus that are spaced from the longitudinal axis 120. For instance, these plateaus 136 may be equidistantly spaced from the longitudinal axis 120. The outer plateaus 136 can be distanced from the longitudinal axis 120 at a distance approximately halfway from the longitudinal axis 120 to the body positioning apparatus's top edge 162*a* or bottom edge 162*b*. For instance, the plateaus 136 may be spaced between approximately 6-10 inches from the longitudinal axis 120, and more preferably approximately 8 inches from the longitudinal axis 120. Stated differently, the plateaus 136 may be spaced from one another by a distance of approximately 16 inches. Additionally, the plateaus 136 may be offset from the latitudinal axis 122, for instance, by approximately 1-8 inches, and more preferably approximately 2 inches. As such, the lower outer plateaus 136 extend from the latitudinal axis 122 by 2-7.5 inches. The two plateaus 136 can range from between 2-8 inches in length and 1-5 inches in width, and as shown are approximately 5.5 inches in length and 3 inches in width. Again, these distances are exemplary, but should not be construed as limiting. Any of these dimensions could be changed without departing from the spirit of the present invention.

Further still, the body positioning apparatus 110 has lower center plateau 138, which serves as a foot bar, that runs along the longitudinal axis 120. Additionally, the lower center plateau 138 may be offset from the latitudinal axis 122 by approximately 15-30 inches, and more preferably approximately 22 inches. The plateau 138 can range from 3 to 16 inches in length and 2 to 8 inches in width. As shown, lower center plateau 138 is approximately 9 inches long and approximately 3 inches wide. As such, the lower center plateau 138 may extend from the latitudinal axis 122 by 22-31 inches. Again, these distances are exemplary, but should not be construed as limiting. Any of these dimensions could be changed without departing from the spirit of the present invention.

Additionally, the body position apparatus 10 or 110 may be specifically configured to easily nest, collapse, or fold onto itself for ease of transportation, storage, and the like. For instance, looking to FIG. 6, various fold lines are provided. Additionally, the apparatus 10, 110 may include depressions (not shown) that are compatible with the various plateaus. More specifically, these depressions may be formed into the front planar surface of the apparatus 10, 110 at locations cometary to the plateaus such that when the apparatus 10, 110 is folded, the plateaus nest within the depressions.

Figure 8:
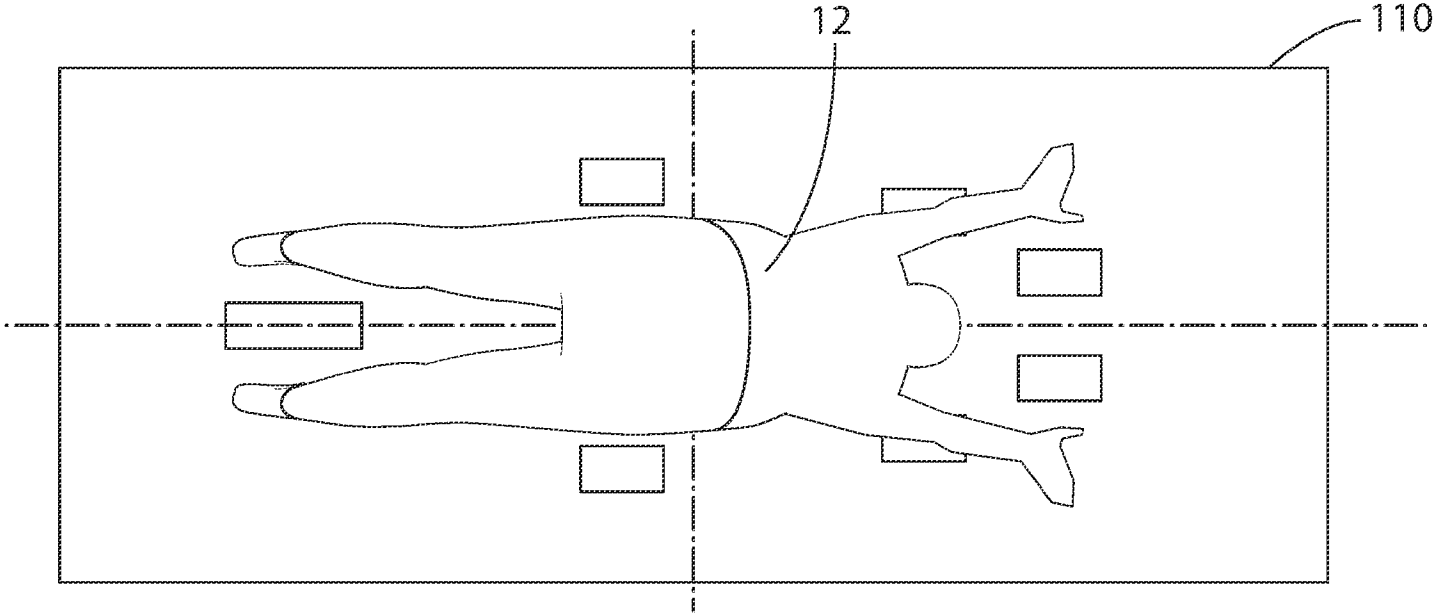
FIG. 8 is a top plan view of the inventive body positioning apparatus of FIGS. 5-7 with a user in a first position.
Figure 9:
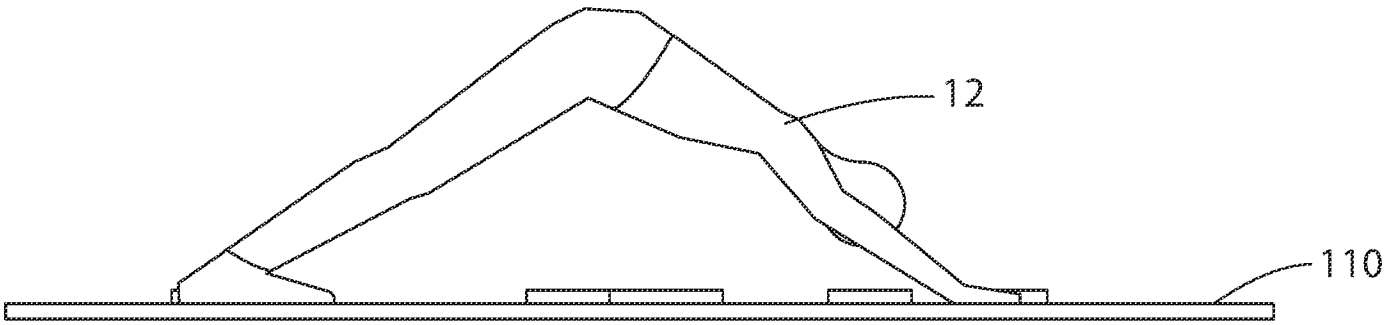
FIG. 9 is a side elevation view of the inventive body positioning apparatus of FIGS. 5-8 with the user in the first position.
Figure 10:
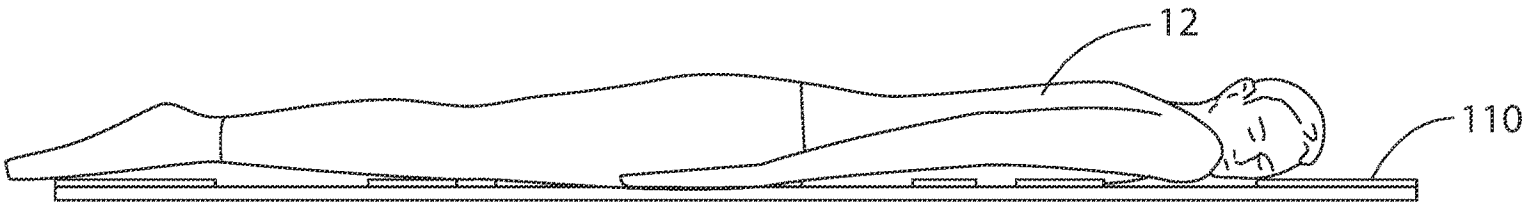
FIG. 10 is a side elevation view of the inventive body positioning apparatus of FIGS. 5-8 with the user in a second position.
Figure 11:
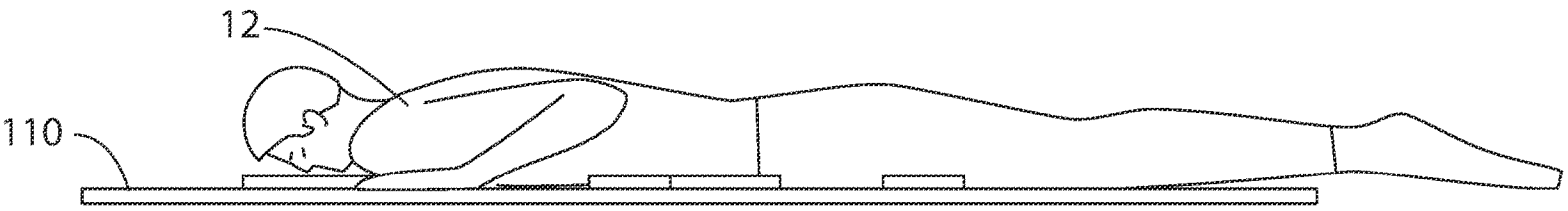
FIG. 11 is a side elevation view of the inventive body positioning apparatus of FIGS. 5-8 with the user in a third position.
Figure 12:
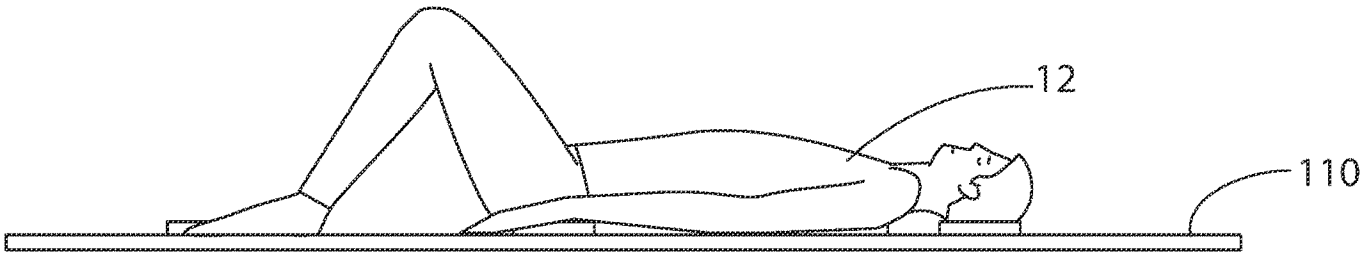
FIG. 12 is a side elevation view of the inventive body positioning apparatus of FIGS. 5-8 with a user in a fourth position.

Finally, FIGS. 8-12 are included to show some exemplary positions in which a user 12 is oriented relative to the apparatus 110. More specifically, FIG. 12 shows a user 12 in a supine position on the apparatus 110. Additionally, FIGS. 8 and 9 shows a user 12 in a down-facing position relative to the apparatus 110. Further still, FIG. 11 shows a user 12 in a prone position relative to the apparatus 110.

Understandably, the present invention has been described above in terms of one or more preferred embodiments. It is recognized that various alternatives and modifications can be made to these embodiments that are within the scope of the present invention. For instance, the various described plateaus are exemplary in nature, and additional or fewer plateaus may be included. Similarly, the plateaus need not take the specific dimensions described above but could vary substantially. It is also to be understood that, although the foregoing description and drawings describe and illustrate in detail one or more preferred embodiments of the present invention, to those skilled in the art to which the present invention relates, the present disclosure will suggest many modifications and constructions as well as widely differing embodiments and applications without thereby departing from the spirit and scope of the invention. The present invention, therefore, is intended to be limited only by the scope of the appended claims.

The invention claimed is:

1. A body positioning apparatus made of a material sized and shaped to support at least one user body comprising a mat comprised of (a) an outer surface upon which at least part of the user body is supported, (b) a discrete head landmark comprised of an upraised head landmark plateau and configured to position a head of a user relative thereto, (c) a pair of spaced apart discrete shoulder landmarks each comprised of an upraised shoulder landmark plateau and configured to position a pair of shoulders of the user relative thereto, (d) a pair of spaced apart discrete hand landmarks each comprised of an upraised hand landmark plateau and configured to position a pair of hands of the user relative thereto; (e) a discrete foot landmark comprised of an upraised foot landmark plateau and configured to position a pair of feet of the user relative thereto, and (f) a discrete pelvis landmark arrangement comprising discrete first, second and third pelvis landmarks respectively comprised of upraised first, second and third pelvis landmark plateaus and configured to position a pelvis of the user relative thereto;

wherein the first and second pelvis landmarks are generally parallel to each other and spaced apart from one another in the widthwise direction;

wherein the first and second pelvis landmarks are each elongate and oriented with a respective lengthwise extent thereof extending in a lengthwise direction relative to the mat;

wherein the third pelvis landmark is disposed interjacent the first and second pelvis landmarks;

wherein the third pelvis landmark is elongate and oriented with a lengthwise extent thereof extending in the widthwise direction of the mat from one of the first and second pelvis landmarks to the other one of the first and second pelvis landmarks;

wherein the pair of hand landmarks are elongate, parallel, and configured to position a corresponding one of a pair of hands of a user on the outer surface of the mat adjacent a respective one of the hand landmarks; and wherein the foot landmark is elongate and configured to position a pair of feet of the user body on the outer surface of the mat with the foot landmark disposed between the feet of the user during use of the body positioning apparatus.

2. The body positioning apparatus of claim 1, wherein the mat is elongate, generally rectangular, comprised of a pliant and resilient material, has a length of between 65 and 84 inches, a width of between 18 and 34 inches, and a thickness of between 0.5 and 1.0 inches, wherein the outer surface of the mat is generally planar, and wherein each one of the upraised head, shoulder, hand, foot, and pelvis landmark plateaus are upraised between 0.20 inches and 1 inch from the generally planar outer surface of the mat.

3. The body positioning apparatus of claim 1, wherein each one of the upraised head, shoulder, hand, foot, and pelvis landmark plateaus are configured to be engaged by a corresponding one of a head, shoulder, hand, foot, or pelvis of a user of the mat to position the corresponding one of the head, shoulder, hand, foot, or pelvis of the user of the mat relative thereto.

4. The body positioning apparatus of claim 1, wherein the outer surface of the mat is generally planar, and wherein each one of the upraised head, shoulder, hand, foot, and pelvis landmark plateaus comprise a generally rectangular upraised plateau upraised between 0.20 inches and 1 inch from the generally planar outer surface of the mat.

5. The body positioning apparatus of claim 1, wherein the first, second, and third pelvis landmarks define a substantially H-shaped pelvis landmark arrangement.

6. The body positioning apparatus of claim 5, wherein each one of the upraised head, shoulder, hand, foot, and pelvis landmark plateaus are configured to be engaged by a corresponding head, shoulder, hand, foot, and pelvis of a user of the mat to position the corresponding head, shoulder, hand, foot, and pelvis of the user of the mat relative thereto.

7. A body positioning apparatus made of a material sized and shaped to support at least one user body comprising a mat comprised of (a) an outer surface upon which at least part of the user body is supported, and (b) a discrete head landmark comprised of an upraised head landmark plateau and configured to position a head of a user relative thereto, (c) a pair of spaced apart discrete shoulder landmarks each comprised of an upraised shoulder landmark plateau and configured to position a pair of shoulders of the user relative thereto, (d) a pair of spaced apart discrete hand landmarks each comprised of an upraised hand landmark plateau and configured to position a pair of hands of the user relative thereto; (e) a discrete foot landmark comprised of an upraised foot landmark plateau and configured to position a pair of feet of the user relative thereto, and (f) a discrete pelvis landmark comprised of an upraised pelvis landmark plateau and configured to position a pelvis of the user relative thereto;

wherein the pair of hand landmarks are elongate, parallel, and configured to position a corresponding one of a pair of hands of a user on the outer surface of the mat adjacent a respective one of the hand landmarks; and wherein the foot landmark is elongate and configured to position a pair of feet of the user body on the outer surface of the mat with the foot landmark disposed between the feet of the user during use of the body positioning apparatus.

8. The body positioning apparatus of claim 7, wherein the mat is elongate and extends (a) in a lengthwise direction between a pair of spaced apart ends, and (b) in a widthwise direction between a pair of spaced apart sides, wherein the head landmark is disposed in a lengthwise direction relative to the mat closer to one end of the mat than the other end of the mat, the head landmark spaced from the one end of the mat, wherein the foot landmark is disposed in a lengthwise direction relative to the mat closer to the other end of the mat than the one end of the mat, wherein the pelvis landmark is disposed in a lengthwise direction relative to the mat interjacent the head landmark and the foot landmark, and wherein the pair of spaced apart shoulder landmarks are disposed in a lengthwise direction relative to the mat interjacent the head landmark and the pelvis landmark.

9. The body positioning apparatus of claim 7, wherein the mat is elongate and extends (a) in a lengthwise direction between a pair of spaced apart ends, and (b) in a widthwise direction between a pair of spaced apart sides, and wherein the pair of hand landmarks are disposed in a lengthwise direction relative to the mat interjacent the shoulder landmarks and the foot landmark, wherein one of the hand landmarks is spaced in a widthwise direction relative to the mat in one direction outwardly of the pelvis landmark and has at least one portion thereof extending in a lengthwise direction alongside at least a portion of one side of the pelvis landmark and another portion extending in a lengthwise direction beyond the one side of the pelvis landmark toward an end of the mat to which the foot landmark is disposed closest, and wherein the other one of the hand landmarks is spaced in a widthwise direction relative to the mat in an opposite direction outwardly of the pelvis landmark and has at least one portion thereof extending alongside at least a portion the other side of the pelvis landmark and another portion extending in a lengthwise direction beyond the other side of the pelvis landmark toward an end of the mat to which the foot landmark is disposed closest.

10. The body positioning apparatus of claim 7, further comprising a longitudinal line extending in a lengthwise direction relative to the mat;

wherein the longitudinal line extends between the pair of hand landmarks equidistantly spacing each hand landmark from the longitudinal line a first distance, and the longitudinal line extends between the pair of shoulder landmarks equidistantly spacing each shoulder landmark from the longitudinal line a second distance that is less than the first distance;

wherein the head landmark comprises first and second head landmarks spaced from an adjacent-most end of the mat; and wherein the longitudinal line extends between the first and second head landmarks equidistantly spacing the first and second head landmarks from the longitudinal line a third distance that is less than the second distance.

11. The body positioning apparatus of claim 10, wherein the longitudinal line is a longitudinally extending centerline that bisects the mat.

12. The body positioning apparatus of claim 7, wherein the foot landmark is elongate and oriented with its lengthwise extent longitudinally extending along a portion of the longitudinal line.

13. The body positioning apparatus of claim 7, wherein the outer surface of the mat is generally planar, and wherein each one of the head, shoulder, hand, foot, and pelvis landmarks comprises a discrete upraised plateau upraised from the generally planar outer surface of the mat that is upraised between 0.20 inches and 1 inch from the generally planar outer surface of the mat.

14. The body positioning apparatus of claim 7, wherein the mat is configured for use in practicing Pilates.

15. The body positioning apparatus of claim 14, wherein the mat is elongate and extends (a) in a lengthwise direction between a pair of spaced apart ends, and (b) in a widthwise direction between a pair of spaced apart sides, wherein the head landmark comprises a pair of elongate spaced apart and parallel first and second head landmarks configured to position a head of the user body relative thereto, and wherein each one of the elongate head, hand and foot landmarks are oriented with their respective lengthwise extents extending in a lengthwise direction relative to the mat.

16. The body positioning apparatus of claim 7, wherein the mat is elongate and extends (a) in a lengthwise direction between a pair of spaced apart ends, and (b) in a widthwise direction between a pair of spaced apart sides, wherein the head landmark comprises a pair of elongate spaced apart and parallel first and second head landmarks configured to position a head of the user body relative, wherein the head landmarks are disposed closer to one end of the mat than the other end of the mat, wherein the foot landmark is disposed closer to the other end of the mat than the one end of the mat, wherein the pelvis landmark is disposed in a lengthwise direction relative to the mat interjacent the head landmarks and the foot landmark, and wherein the shoulder landmarks are disposed in a lengthwise direction relative to the mat interjacent the head landmark and the pelvis landmark.

17. The body positioning apparatus of claim 7, wherein the mat extends in a lengthwise direction between a pair of spaced apart ends and in a widthwise direction between a pair of spaced apart sides, wherein the mat has a longitudinal axis extending in the lengthwise direction of the mat and a latitudinal axis extending in a direction generally transverse to the lengthwise direction of the mat, wherein the head landmark is disposed between one end of the mat and the latitudinal axis, the head landmark spaced from the one end of the mat, wherein the pair of shoulder landmarks are disposed between the head landmark and the latitudinal axis with one of the shoulder landmarks disposed on one side of the longitudinal axis and the other one of the shoulder landmarks disposed on the other side of the longitudinal axis, wherein the foot landmark is disposed between the other end of the mat and the latitudinal axis, wherein the hand landmarks are disposed between the foot landmark and the latitudinal axis with one of the hand landmarks disposed on one side of the longitudinal axis and the other one of the hand landmarks disposed on the other side of the longitudinal axis, and wherein the pelvis landmark is disposed between the foot landmark and the shoulder landmarks.

18. The body positioning apparatus of claim 17, wherein the head landmark comprises first and second head landmarks with one of the first and second head landmarks disposed on one side of the longitudinal axis and the other one of the first and second head landmarks disposed on the other side of the longitudinal axis, wherein one of the shoulder landmarks is disposed on the one side of the longitudinal axis and spaced farther from the longitudinal axis than the first one of the head landmarks and the other one of the shoulder landmarks is disposed on the other side of the longitudinal axis and spaced farther from the longitudinal axis than the second one of the head landmarks, and wherein one of the hand landmarks is spaced outwardly from at least a portion of the pelvis landmark on one side of the pelvis landmark and the other one of the hand landmarks is spaced outwardly from at least another portion of the pelvis landmark on the other side of the pelvis landmark.

19. The body positioning apparatus of claim 17, wherein the foot landmark extends along the longitudinal axis.

20. The body positioning apparatus of claim 7, wherein the mat is generally rectangular and comprised of a resilient and pliable material, the outer surface of the mat is generally planar, has a thickness of between 0.5 and 1.0 inches and wherein each one of the upraised head, shoulder, hand, foot, and pelvis landmark plateaus extend between 0.20 inches and 1 inch above the generally planar outer surface of the mat.

21. The body positioning apparatus of claim 7, wherein the mat is elongate, has a pair of opposite ends, and has a pair of opposite sides;

wherein the head landmark is comprised of a pair of head landmarks;

wherein the pair of head landmarks, the pair of shoulder landmarks, and the pair of hand landmarks are disposed on and equidistantly outwardly spaced on opposite sides of a longitudinally extending axis of the mat wherein the head landmarks are spaced from one end of the mat closest thereto, the foot landmark is spaced from the other end of the mat closest thereto, the shoulder landmarks are spaced longitudinally from the head landmarks and the foot landmark such that the shoulder landmarks are disposed interjacent the head landmarks and the foot landmark, the pelvis landmark and the hand landmarks are spaced longitudinally from the shoulder landmarks and the foot landmark such that the pelvis landmark and hand landmarks are disposed interjacent the shoulder landmarks and the foot landmark; and wherein the shoulder landmarks are spaced farther outwardly from the longitudinal axis of the mat than the head landmarks, and the hand landmarks are spaced farther outwardly from the longitudinal axis of the mat than the pelvis landmark.

22. The body positioning apparatus of claim 21, wherein the hand landmarks extend in a direction toward the other end of the mat farther longitudinally than the pelvis landmark, and wherein the hand landmarks are spaced farther outwardly from the longitudinal axis of the mat than the shoulder landmarks are spaced outwardly from the longitudinal axis of the mat.

23. The body positioning apparatus of claim 22, wherein the pelvis landmark is comprised of a pair of spaced apart pelvis landmarks spaced equidistantly on opposite sides of the longitudinal axis, wherein the pair of spaced apart pelvis landmarks are aligned along a latitudinal axis of the mat that extends generally perpendicularly to the longitudinal axis, wherein the shoulder landmarks and head landmarks are spaced from the latitudinal axis and disposed on one side the latitudinal axis between the latitudinal axis and one end the mat, and wherein the pair of hand landmarks and the foot landmark are spaced from the latitudinal axis and disposed on the other side the latitudinal axis between the latitudinal axis and the other end the mat.

24. The body positioning apparatus of claim 23, wherein the pair of the pelvis landmarks spaced equidistantly on opposite sides of the latitudinal axis comprise longitudinally extending pelvis landmarks, and further comprising a latitudinally extending pelvis landmark disposed interjacent the pair of longitudinally extending pelvis landmarks.

25. The body positioning apparatus of claim 24, wherein the latitudinally extending pelvis landmark extends from one of the longitudinally extending pelvis landmarks to the other one of the longitudinally extending pelvis landmarks defining a generally H-shaped pelvis landmark.

26. The body positioning apparatus of claim 25, wherein the foot landmark extends in a longitudinal direction along the longitudinal axis of the mat, and is centered on the longitudinal axis of the mat, wherein the longitudinal axis of the mat bisects the latitudinally extending pelvis landmark, wherein the latitudinally extending pelvis landmark is elongate, extends in a latitudinal direction along the latitudinal axis of the mat, and is centered on the latitudinal axis of the mat, and wherein the latitudinal axis of the mat bisects both of the longitudinally extending pelvis landmarks.

27. The body positioning apparatus of claim 26, wherein each one of the upraised head, shoulder, hand, foot, and pelvis landmark plateaus are upraised from the outer surface of the mat between 0.20 inches and 1 inch.

28. The body positioning apparatus of claim 27, wherein the outer surface of the mat is generally planar and wherein each one of the upraised head, shoulder, hand, foot, and pelvis landmark plateaus are upraised from the generally planar outer surface of the mat about 0.25 inches.

29. The body positioning apparatus of claim 28, wherein the longitudinal axis comprises a central longitudinal axis of the mat extending along a longitudinal centerline of the mat and the latitudinal axis comprises a central latitudinal axis of the mat extending along a latitudinal centerline of the mat.

30. The body positioning apparatus of claim 7, wherein each one of the head landmark plateaus is generally rectangular, has a length of between 3 to 6 inches, and has a width of between 2 to 4 inches, each one of the shoulder landmark plateaus is generally rectangular, has a length of between 3 to 6 inches, and has a width of between 5 to 10 inches, each one of the longitudinally extending pelvis landmark plateaus are generally rectangular, has a length of between 8 to 10 inches, and has a width of between 2 to 4 inches, the latitudinally extending pelvis landmark plateau is generally rectangular, has a length of between 2 to 8 inches, and has a width of between 1 to 5 inches, each one of the hand landmark plateaus is generally rectangular, has a length of between 2 to 8 inches, and has a width of between 1 to 5 inches, and the foot landmark plateau is generally rectangular, has a length of about 9 inches and a width of about 3 inches.

* * * * *